US007325789B2

(12) United States Patent
Buth et al.

(10) Patent No.: US 7,325,789 B2
(45) Date of Patent: Feb. 5, 2008

(54) BOX BEAM TERMINALS

(75) Inventors: C. Eugene Buth, Wellborn, TX (US); Roger P. Bligh, Bryan, TX (US); Dean C. Alberson, Bryan, TX (US); D. Lance Bullard, Jr., College Station, TX (US); Hayes E. Ross, Jr., College Station, TX (US); Akram Abu-Odeh, College Station, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 11/682,442

(22) Filed: Mar. 6, 2007

(65) Prior Publication Data

US 2007/0147957 A1 Jun. 28, 2007

Related U.S. Application Data

(63) Continuation of application No. 10/199,540, filed on Jul. 19, 2002, now Pat. No. 7,185,882.

(60) Provisional application No. 60/306,970, filed on Jul. 20, 2001.

(51) Int. Cl.
*E01F 15/00* (2006.01)
*E04H 17/14* (2006.01)

(52) U.S. Cl. ..... 256/13.1; 256/19

(58) Field of Classification Search ..... 256/13.1
See application file for complete search history.

(56) References Cited

U.S. PATENT DOCUMENTS

| | | | | |
|---|---|---|---|---|
| 4,928,928 | A | 5/1990 | Buth et al. | 256/13.1 |
| 5,078,366 | A | 1/1992 | Sicking et al. | 256/13.1 |
| 5,391,016 | A | 2/1995 | Ivey et al. | 404/6 |
| 6,109,597 | A | 8/2000 | Sicking et al. | 256/13.1 |
| 6,505,820 | B2 | 1/2003 | Sicking et al. | 256/13.1 |
| 6,554,256 | B2 | 4/2003 | Ochoa | 256/13.1 |
| 6,561,492 | B1 | 5/2003 | Hubbell | 256/13.1 |

FOREIGN PATENT DOCUMENTS

GB 2294489 A 5/1996

*Primary Examiner*—Rehana Perveen
*Assistant Examiner*—Stefan Stoynov
(74) *Attorney, Agent, or Firm*—Baker Botts L.L.P.

(57) ABSTRACT

Guardrail installation designs are described that incorporate a box beam rail as the structural rail member. The box beam rail member may have an open cross-section or a closed cross-section. An impact head is provided to bend and deflect the rail member during an end-on collision, allowing the rail member to be deflected away from the roadway and out of the path of an end-on impacting vehicle. The impact head includes a striking face and a chute portion that receives the box beam rail member therewithin. In addition to bending and deflecting the rail member, the impact head may also include a flattening section for flattening the rail member.

24 Claims, 11 Drawing Sheets

15
34
30
14'
54
20
15
56
12
10
52
13
18
26
22
24'
58

30
36
28
42
15
14
38
40
50
32
34
20'
15
12
10
52
13
18
26
22'
13a

BOX BEAM TERMINALS

RELATED APPLICATIONS

This application is a continuation of U.S. application Ser. No. 10/199,540, filed Jul. 19, 2002, and entitled "BOX BEAM TERMINALS," now U.S. Pat. No. 7,185,882. U.S. application Ser. No. 10/199,540, claims priority from U.S. Provisional Application Ser. No. 60/306,970, entitled "BOX BEAM TERMINALS," filed on Jul. 20, 2001.

BACKGROUND OF THE INVENTION

1. Field of the Invention

The invention relates to box beam style guardrail installations and safety end treatments for such installations. The invention also relates to methods of use associated with these devices.

2. Description of the Related Art

Guardrail installations are used along roadways to prevent errant vehicles from leaving a roadway wherein they may encounter hazards that are a substantial danger to them. In its simplest form, the guardrail installation features a horizontally disposed rail member that is supported above the ground by a series of support posts. The rail member is most commonly provided by longitudinal segments of corrugated sheet steel having a W-shaped cross-section. Other corrugated rail members, such as the "thrie-beam" are used in some situations. Alternative guardrail installation designs, and those that this patent is concerned with, incorporate a box beam rail member wherein the rail member is a tubular beam member having a square or rectangular cross-section. Box beam terminals are popular in some northern tier markets, including New York and Wyoming, primarily because the use of box beams permits wider support post spacing and greater ground clearance and, hence, reduces snow drift problems in winter time.

A guardrail installation should be installed along a roadside or median such that its ends do not in themselves form a hazard. Early guardrail installations lacked any safety termination at the upstream ends, and occasionally, impacting vehicles became impaled on the ends causing intense deceleration of the vehicle and severe injury to the occupants. In some reported cases, the guardrail end penetrated into the occupant compartment of the vehicle with fatal results.

Upon recognition of the need for proper upstream guardrail termination, guardrail installation designs were developed to reduce the hazard associated with the end of the guardrail. One commonly used technique was to "turn down" the end of the guardrail and bury it into the ground. This method has some recognized disadvantages, including an unintended possibility of ramping an approaching vehicle off the ground during a collision, which can result in a violent vehicular rollover.

A number of end treatments have also been developed for use with corrugated rail members. Perhaps the most popular of these, end treatments is the Guardrail Extruder Terminal, described in U.S. Pat. Nos. 4,928,928 and 5,078,366, which have been assigned to the assignee of the present invention and are incorporated herein by reference. Guardrail Extruder Terminal end treatments are known commercially as "ET-2000." Other end treatments are known as well that are useful for corrugated rail-style guardrail installations.

Box beam guardrail installations have significantly different, and fewer, end treatments as compared with corrugated rail guardrail installations. This is, in part, because the beam members have a hollow cross section and have a much larger axial buckling load and a much larger lateral bending resistance than the corrugated rail. The tubular nature of the box beam tends to suggest the use of telescoping segments in a collapsing mechanism. One type of box beam guardrail termination is described in U.S. Pat. No. 5,391,016 issued to Ivey et al. and assigned to the assignee of the present invention. In this arrangement, the upstream end of the guardrail installation is provided with nested, telescoping rail segments. The segments are compressed by telescoping inwardly upon one another during an end-on collision. Resistance to the telescoping action is provided by a filler material (i.e., fiberglass) that is mechanically crushed during the compression process. This style of box beam guardrail termination is highly effective. However, proper filler material maybe costly and/or difficult to obtain in some areas. Further, long, slender telescoping tubes, such as those used in some prior art systems, can have stability problems when impacted in an eccentric manner. Such stability problems can restrict the telescoping behavior. Such crushable composite tubes are also subject to manufacturing variability, which can influence the magnitude of the crush force. The decelerations resulting from the staged composite tube design are sensitive to vehicle mass and impact speed.

The present invention addresses the problems of the prior art.

SUMMARY OF THE INVENTION

The invention features guardrail installation designs that incorporate a box beam rail as the structural rail member. Embodiments are described herein in which the box beam rail member has an open cross-section and a closed cross-section. The upstream end of each of these box beam guardrail installations is provided with an impact head that is designed to bend and deflect a box beam member during a collision, thereby allowing the beam member to be deflected in such a manner that it is not a hazard to traffic or occupants of the impacting vehicle. The impact head includes a striking face and a chute portion that receives the box beam rail member therewithin.

In some described embodiments, the box beam member presents a closed square or rectangular cross-section. The chute portion of the impact head is formed by a pair of side plates that grip opposite corners of the box beam member. During an end-on impact to the impact head, the box beam member is bent by the curved plate portion of the impact head. Preferably, the box beam member is also compressed at opposite corners by a flattening section in the impact head and the beam member flattened out to some degree to assist bending.

In other described embodiments, the box beam member has an open square, rectangular, or trapezoidal cross-section wherein there is an opening in one side of the cross-section. In other words, the box beam member has an "open" cross-section. The chute portion of the impact head includes an angular, or peaked, contact face that engages the opening in the box beam member cross-section. In a currently preferred, described embodiment, a box beam member with an open cross-section is used. The chute portion of the impact head incorporates a contact face having a constant angle of bend along its length. The distance between the contact face and the opposing flat plate decreases as the box beam progresses through the impact head. During an end-on impact, the open box beam member is also bent and deflected by the curved plate portion of the impact head. Additionally, it is preferred that the opening of the box beam's cross-section be urged against the contact face, thereby widening the opening. As the impact progresses, the box-beam member is flattened by expansion of the opening in the cross-section. Such flattening assists in bending of the beam member.

In an alternative embodiment, the contact face comprises a plate that is bent along a longitudinal axis such that the angle of the bend changes along the length of the plate.

DETAILED DESCRIPTION OF THE PREFERRED EMBODIMENTS

The concept of the invention is largely described through discussion of currently preferred and exemplary guardrail installations. The present invention provides end treatments for improved safety relating to end-on impacts to box-beam style guardrail installations.

Figure 1:
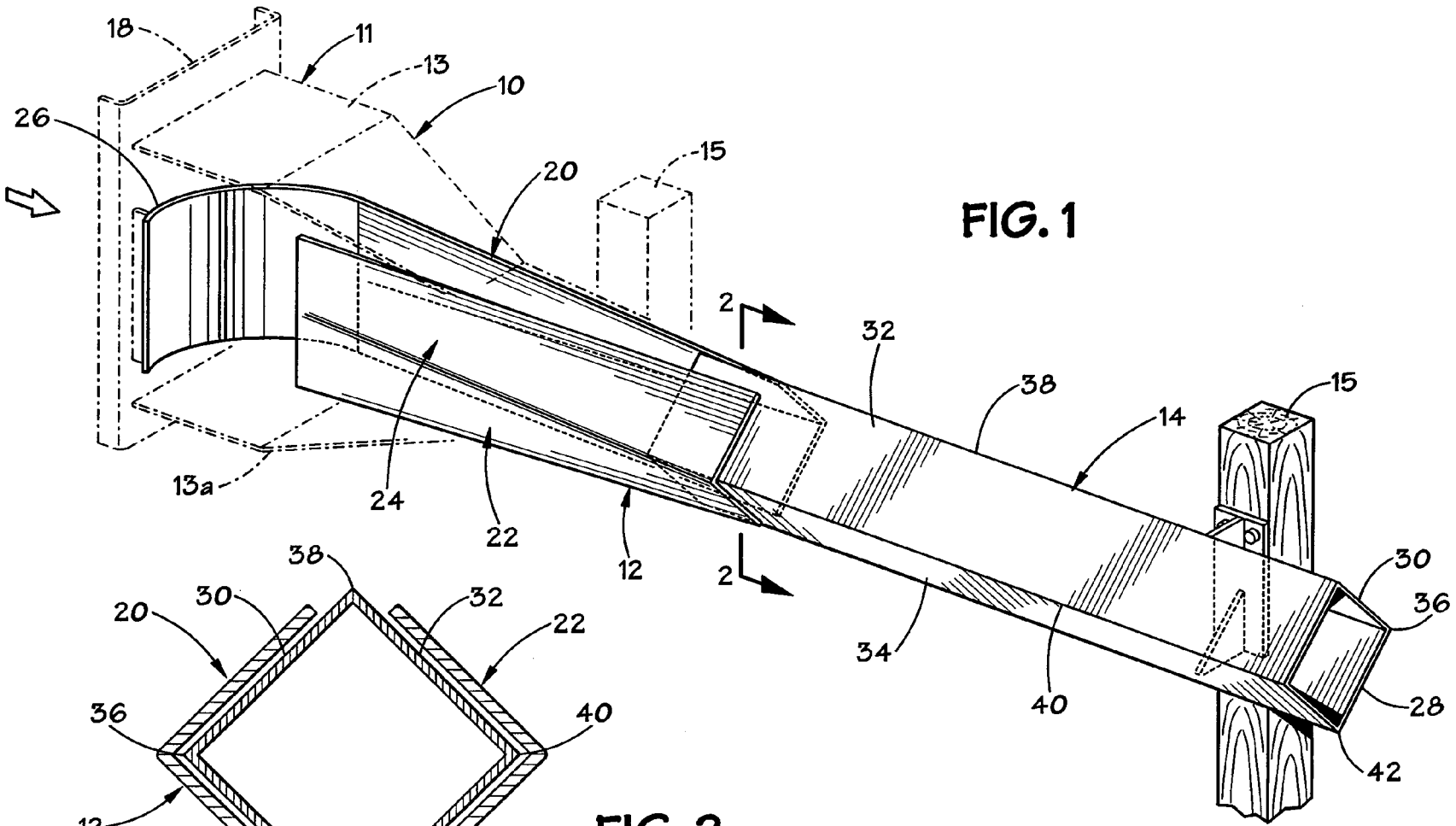
FIG. 1 is an isometric view of a first exemplary embodiment for a box beam terminal for a guardrail installation constructed in accordance with the present invention.
Figure 2:
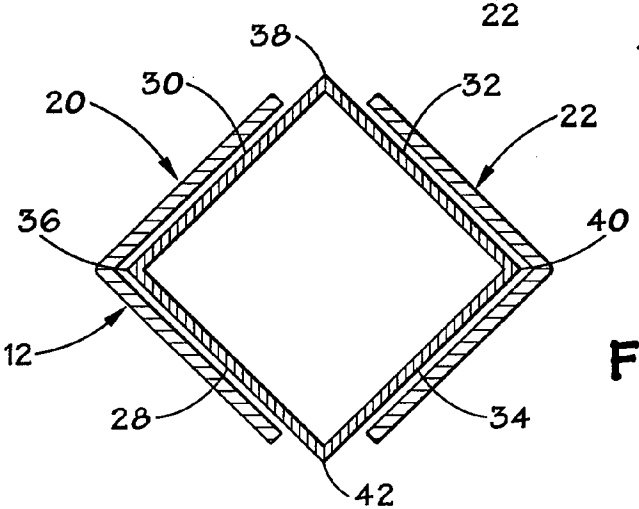
FIG. 2 is a cross section taken along lines 2-2 in FIG. 1.

Referring first to FIGS. 1 and 2, there is shown a first exemplary embodiment for a box-beam style terminal 10. The terminal 10 includes an impact head 11 having an elongated chute 12 that is disposed at the upstream end of a box beam rail member 14. As used herein, the term "upstream" refers to the direction from which an impacting vehicle would be expected to approach. The term "downstream" refers to the opposite direction, i.e., the direction toward which an impacting vehicle would be expected to travel. The terminal 10 includes both the impact head 11 and the rail member 14. The rail member 14 is a box beam rail member having a tubular, non-solid cross section. It is noted that the rail member 14 is supported above the ground (not shown) by a number of support posts 15 and forms one end of an elongated barrier. Typically, the terminal 10 is located alongside a roadway (not shown) or proximate an obstacle (not shown) in a manner known in the art. The impact head 11 includes a chute portion 12 that is encased within the impact head 11. The impact head 11, portions of which are shown in phantom in FIG. 1, provides a striking plate, or striking face, 18 for a vehicle to impact and serves to transmit the force of the impact to the chute portion 12. Upper and lower plate members 13, 13*a* structurally join the striking plate 18 to the chute portion 12. The chute portion 12 is formed of a pair of plate members 20, 22 that are secured within the head 11. Each of the side plate members 20, 22 is substantially vertically disposed. The forward, or upstream, end of the plate member 20 provides a curved plate portion 26 for deflection of a flattened box beam. It is preferred that the plate members 20,22 be oriented to converge toward one another in an upstream direction in order to form a tapered section 24 that flattens the box beam rail member 14. Flattening is accomplished since corners 36 and 40 (see FIG. 2) are forced to approach each other, and corners 38 and 42 are forced to move away from each other. However, the invention also contemplates placement of the plate members 20, 22 (as well as other plate members in other embodiments described herein) in a substantially parallel relation to each other so that the chute portion does not squeeze or flatten the box beam rail member 14. In such a case, the bending and deflection functions of the impact head are carried out by the curved plate portion 26, albeit in a less efficient manner.

Figure 7:
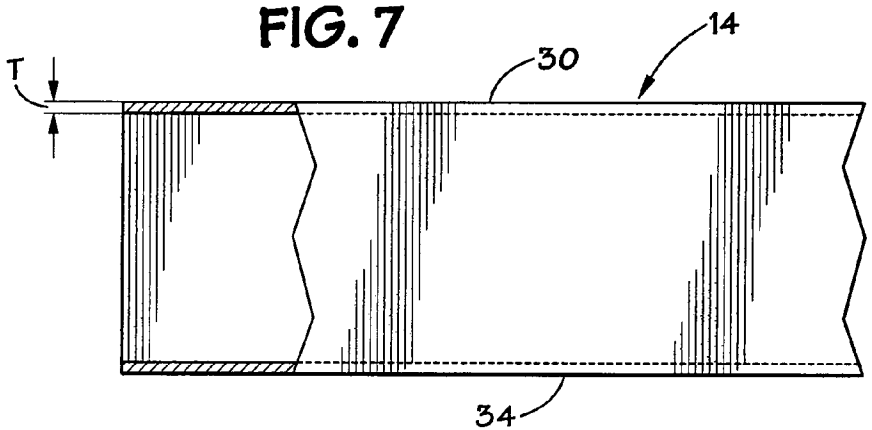
FIG. 7 is a side view, partially cut away, of a typical box beam member.
Figure 6:
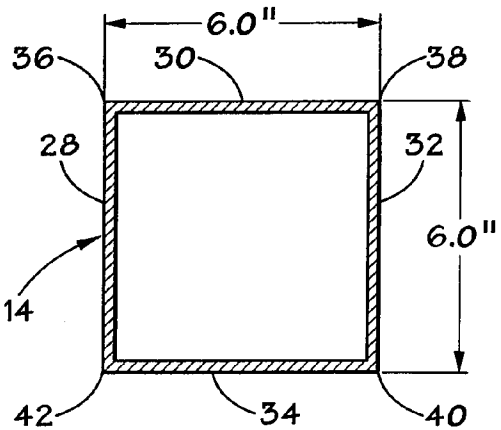
FIG. 6 is a cross-section of a typical box beam rail member.
Figure 8:
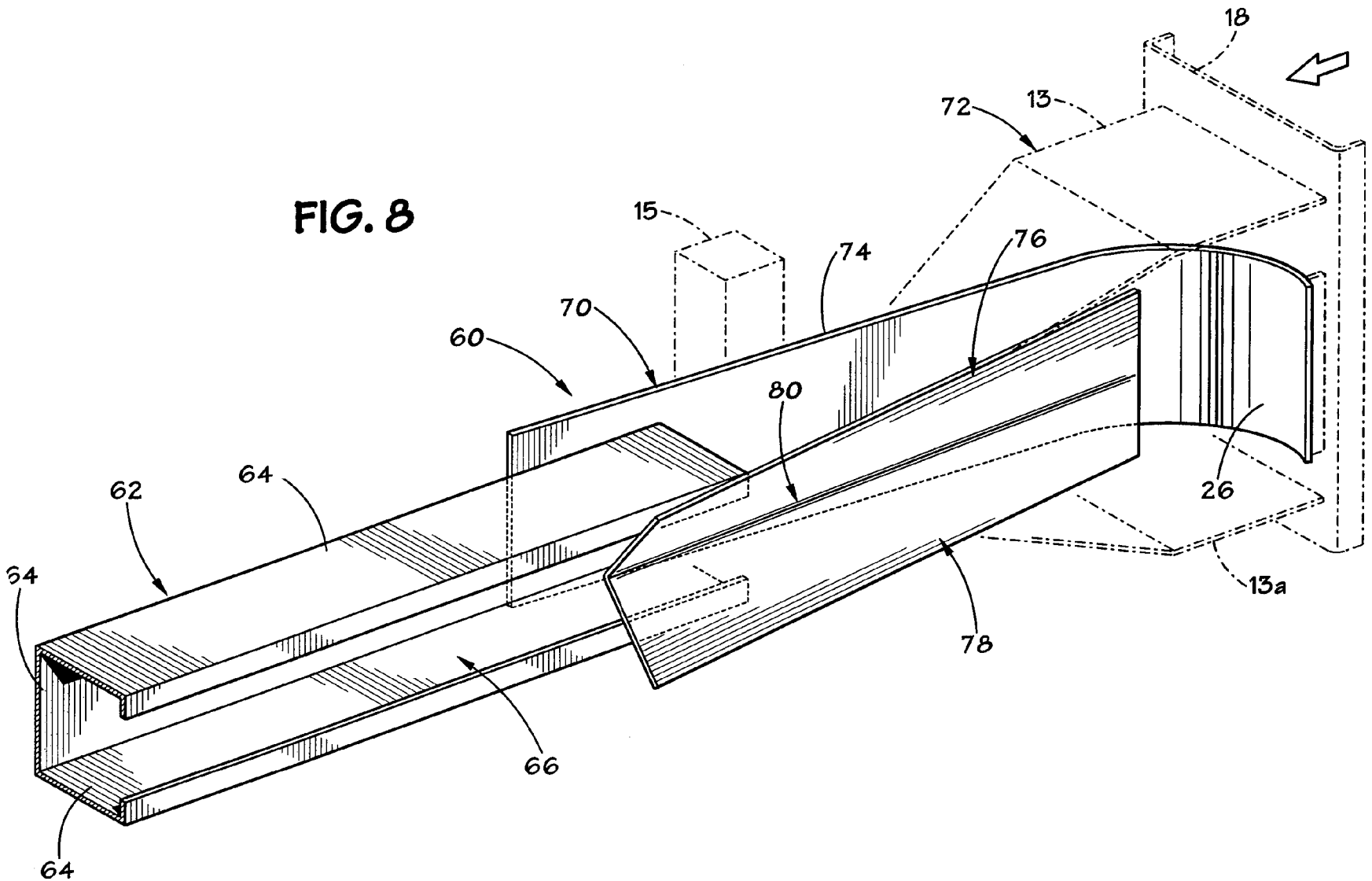
FIG. 8 is an isometric view of a fourth exemplary embodiment for a box beam terminal constructed in accordance with the present invention and wherein an open box beam is utilized.

It is noted that, in this embodiment, the box beam rail member 14 is mounted upon the support posts 15 so that opposing corners 36, 40 of the rail member are engaged by the chute portion 12. FIG. 2 illustrates that the downstream end of each of the plate members 20, 22 presents an L-shaped cross-section forming a 90 degree angle for gripping of opposing corners of the box beam rail member 14. The plate members 20, 22 are located laterally across from one another. The plate members 20, 22 slowly flatten out as the upstream end of the plates 20, 22 are approached until each of the plate members 20, 22 provide essentially flat surfaces that face one another. The box beam rail member 14, as shown best in the cross-sectional view of FIG. 6, presents a square cross-section made up of four sides 28, 30, 32, 34 adjoined to one another at corners 36, 38, 40, 42. In a presently preferred embodiment, the box beam member 14 has a square cross-section measuring 6 inches on each side. FIG. 7, a side, partial cross-section, shows that the sides 30, 34, etc. of the box beam member 14 have a thickness ("T") that, currently, is preferred to be either 3/16" or 1/8". A rectangular cross-section may also be used for the box beam rail member 14, if desired. The rail member 14 is referred to as a "closed box beam" because there is no opening on any side of the beam member's cross-section. As best shown in FIG. 2, the rail member 14 engages the chute portion 12 so that opposing corners (i.e., 36, 40) contact the plate members 20, 22 of the chute portion 12.

During an end-on collision to the terminal 10, the striking plate 18 of the impact head 11 is contacted by the impacting vehicle (not shown) and the chute portion 12 is telescopingly forced onto the rail member 14 by the collision force. As the chute portion 12 is forced onto the rail member 14, the box beam rail member 14 is flattened by the throat 24 so that the two opposing corners 36, 40 are forced toward one another to cause the angle formed at each corner 36, 40 to move from one of 90 degrees to a more obtuse angle. Conversely, the remaining corners 38, 42 begin to form more acute angles. In this manner, the box beam member 14 is flattened by the throat 24. Vehicular energy at collision is partially dissipated by the energy required to flatten the rail member 14 in this manner. Vehicular energy is also dissipated through the exchange of momentum between the impacting vehicle and the mass of the moving terminal parts. The curved portion 26 of the impact head 11 then engages the upstream end of the flattened box beam member 14 and causes the flattened box beam member 14 portions to be bent and deflected away from the roadway so that no obstacle is presented by the deflected rail member.

The terminal 10 provides a crashworthy end treatment for box beam style guardrails used on the roadside or in the median. The end treatment flattens and bends a tubular box beam member and deflects it away from the colliding vehicle. The energy of the impacting vehicle is partially dissipated through the controlled flattening and bending of a tubular box beam section.

Figures 3, 5:
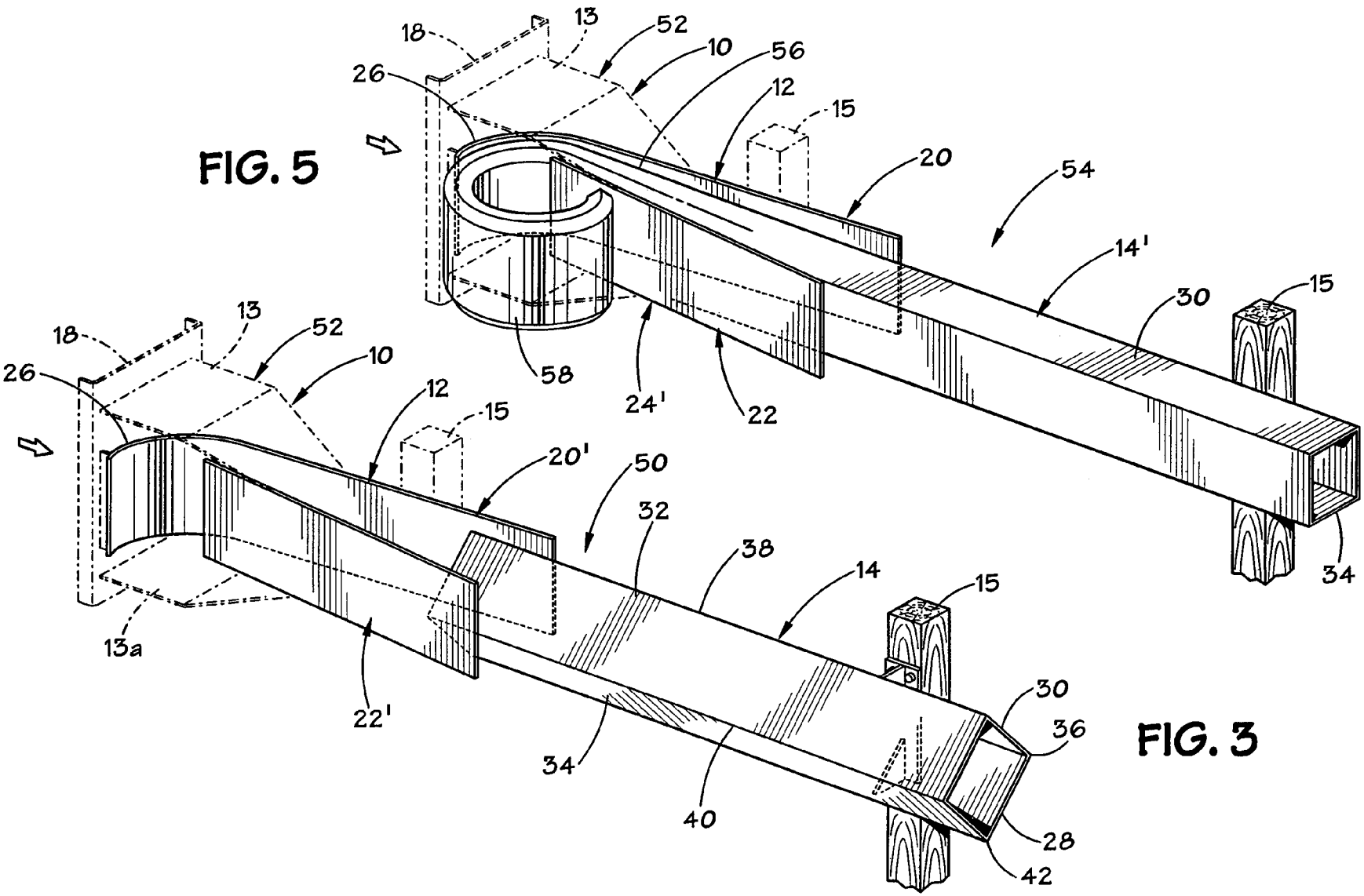
FIG. 3 is an isometric view of a second exemplary embodiment for a box beam terminal constructed in accordance with the present invention.
FIG. 5 is an isometric view of a third exemplary embodiment for a box beam terminal constructed in accordance with the present invention.

Referring now to FIG. 3, there is shown an alternative box beam terminal arrangement 50 for use with a box beam rail member 14. It is noted that like components between the various embodiments shown will share like reference numerals. The terminal 50 includes an impact head 52 having a chute portion 12' that is made up of a pair of substantially flat plates 20', 22'. The plates 20', 22' converge as the upstream end of the impact head 52 is approached, thereby forming a flattening section.

Figure 4:
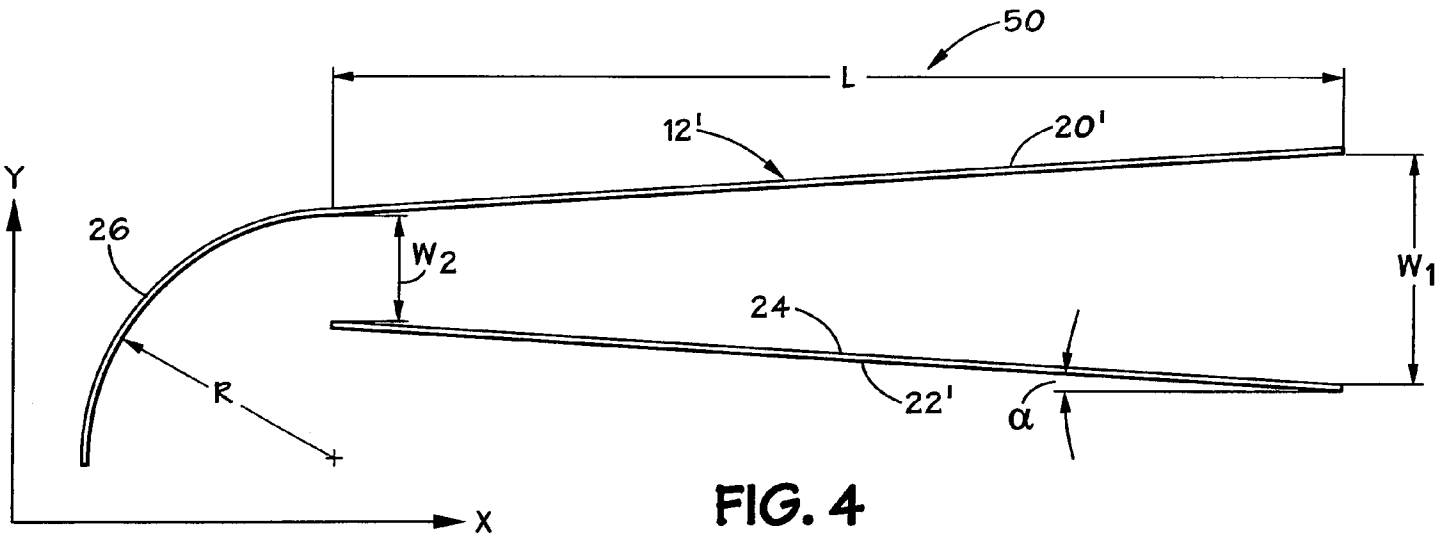
FIG. 4 is a cut-away schematic view of an exemplary impact head used in a box beam terminal.

FIG. 4 shows the impact head 52 in schematic plan view. As illustrated there, the chute portion 12' has a first width ($w_1$) at its downstream end and a second width ($w_2$) at its upstream end. Preferably, the second width ($w_2$) is one-half or less of the first width ($w_1$). In currently preferred dimensions for the chute portion 12', the first width ($w_1$) is 9.5 inches and the second width ($w_2$) is 4.5 inches. To accomplish the needed narrowing, the side plates 20', 22' converge at an angle $\alpha$ of 3.563° over a length (L) of 40 inches. Similar dimensions and angles are useful for constructing the impact head 11 described earlier. Again with reference to FIG. 4, it is noted that the curved plate portion 26 has a currently preferred radius (R) of 10 inches.

Referring now to FIG. 5, an alternative box beam terminal 54 is shown wherein an impact head 52 is disposed upon a rail member 14' that is oriented so that two of the four sides (30, 34) are horizontally disposed. The upstream portion of the rail member 14' includes a seam or score 56 along the upper and lower sides 30, 34 (only the seam on the upper side 30 is visible in FIG. 5). The seams 56 assist an inward collapse of the rail member 14' during a collision. FIG. 5 illustrates a collapsed and extruded portion 58 of the rail member 14'. Those of skill in the art will recognize that the box beam rail member 14' may also be flattened using an impact head having two side plates that are similar to side plates 20', 22' but that have been rotated approximately 45 degrees within the impact head 52. The flattened box beam would then be extruded outwardly from the impact head in a direction that lies along a 45 degree angle from the ground rather than substantially parallel to the ground. In such a case, the rail would be flattened by compression of opposite corners rather than by compression of opposite sides.

Turning now to FIGS. 8, 9, 10, 11, 12, and 13, there is shown a further box beam terminal 60. This embodiment features an "open" box beam member 62 in place of the closed box beam members 14, 14' described earlier. The open box beam member 62 has three solid faces 64 and one open face 66. An open box beam member may have a cross-sectional configuration that is square or rectangular. In addition, an open box beam member may have a trapezoidal cross-sectional configuration, such as the open box beam member 62' illustrated in FIG. 9A. Such a configuration is common today in parts of Europe. A trapezoidal open box beam has an open side 66 that is longer than the opposing side 64 and, as a result, forms a trapezoidal shape.

Figures 9, 9A:
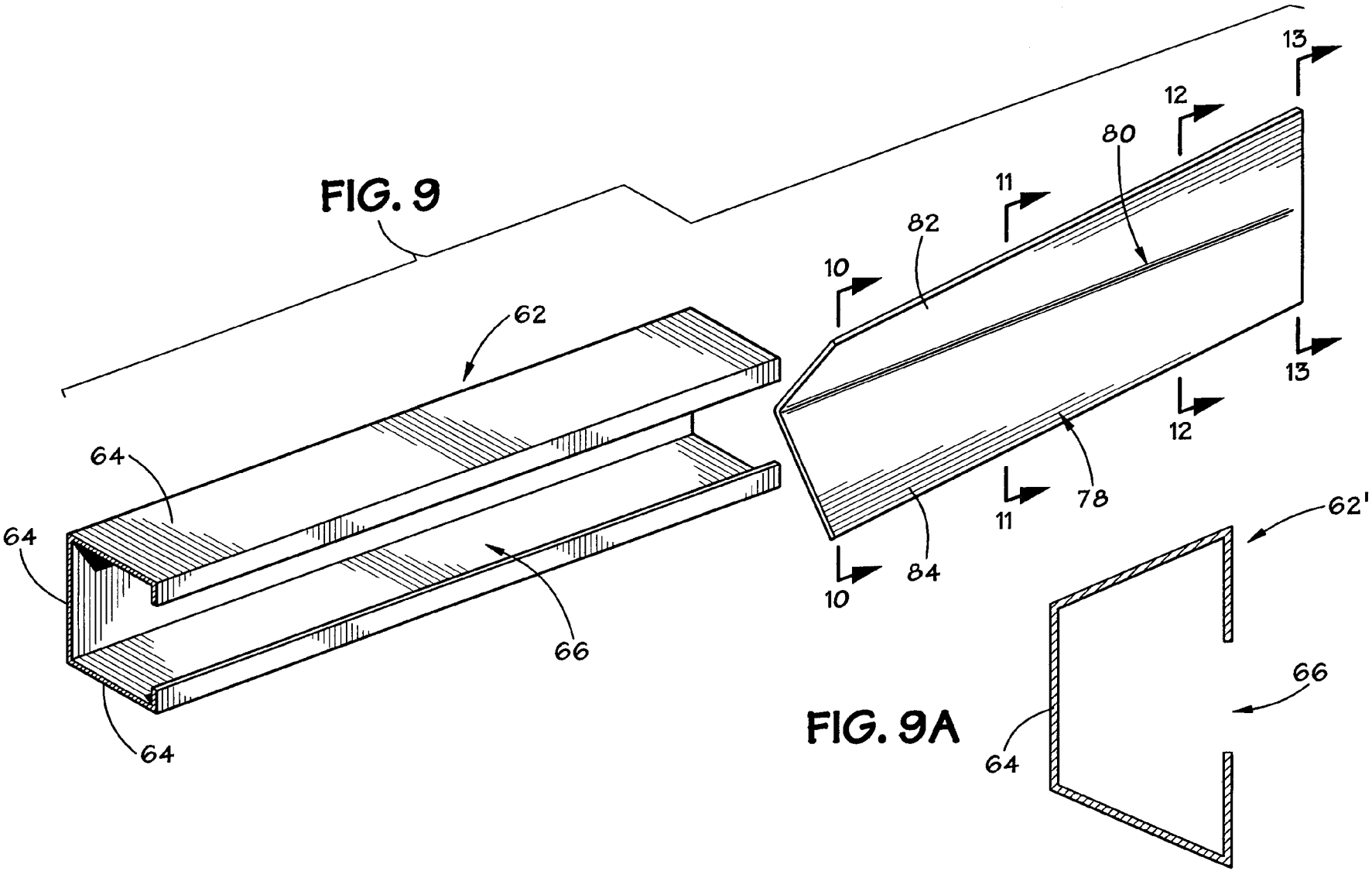
FIG. 9 illustrates a box beam member and side plate from the terminal shown in FIG. 8 apart from other components.
FIG. 9A is a cross-sectional depiction of an open box beam having a trapezoidal configuration.
Figure 10:
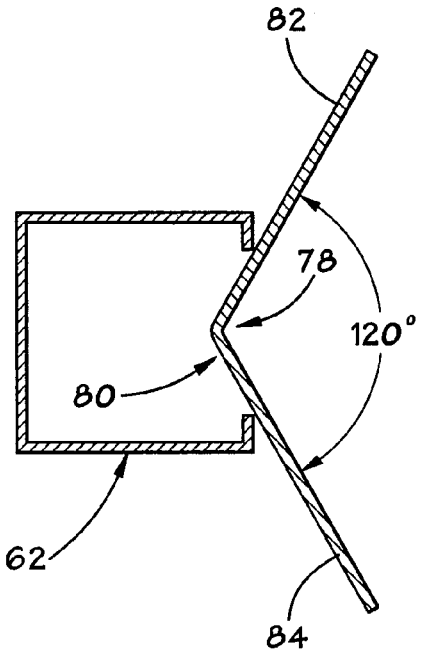
FIG. 10 is a cross-section of the side plate shown in FIG. 9, taken along lines 10-10 in FIG. 9.
Figure 11:
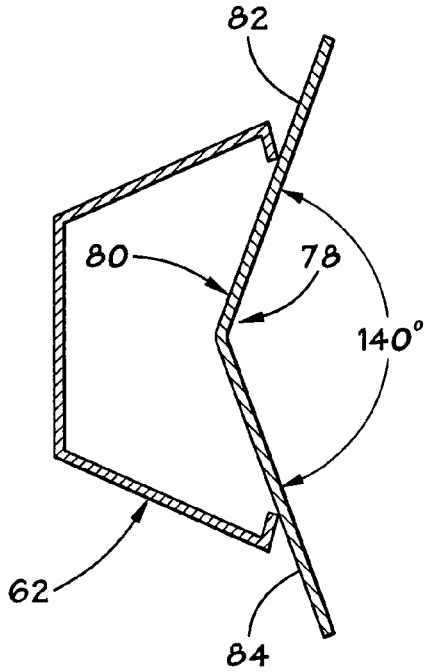
FIG. 11 is a cross-section of the side plate shown in FIG. 9, taken along lines 11-11 in FIG. 9.
Figure 12:
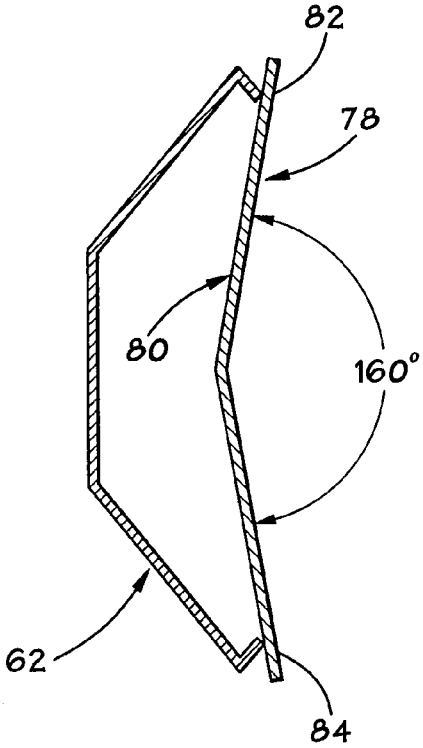
FIG. 12 is a cross-section of the side plate shown in FIG. 9, taken along lines 12-12 in FIG. 9.
Figure 13:
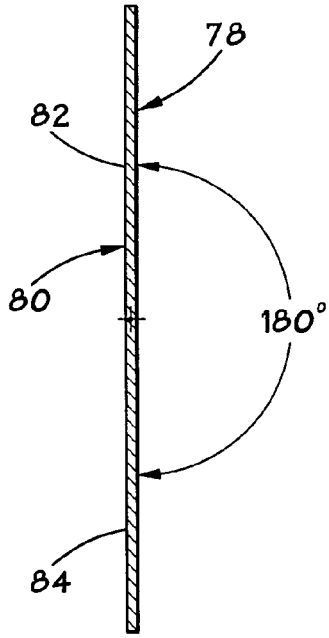
FIG. 13 is a cross-section of the side plate shown in FIG. 9, taken along lines 13-13 in FIG. 9.
Figure 17:
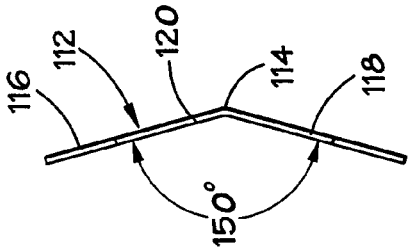
FIG. 17 is a rear end-on view of the side plate shown in FIG. 15.
Figure 15:
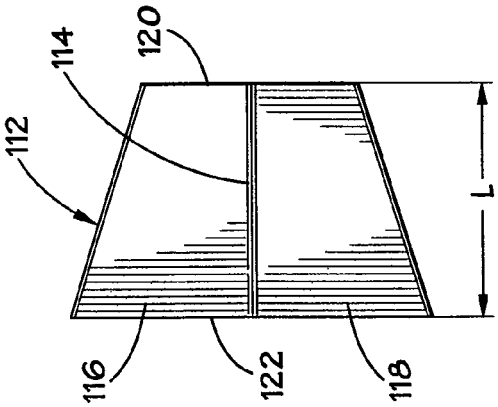
FIG. 15 is a side view of a side plate used in the box beam terminal shown in FIG. 14.
Figure 16:
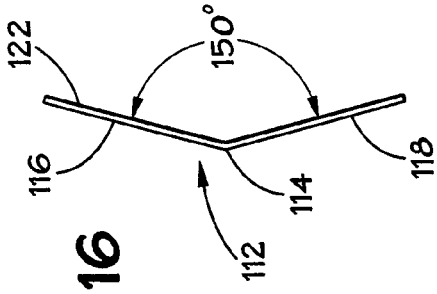
FIG. 16 is a front end-on view of the side plate shown in FIG. 15.
Figure 14:
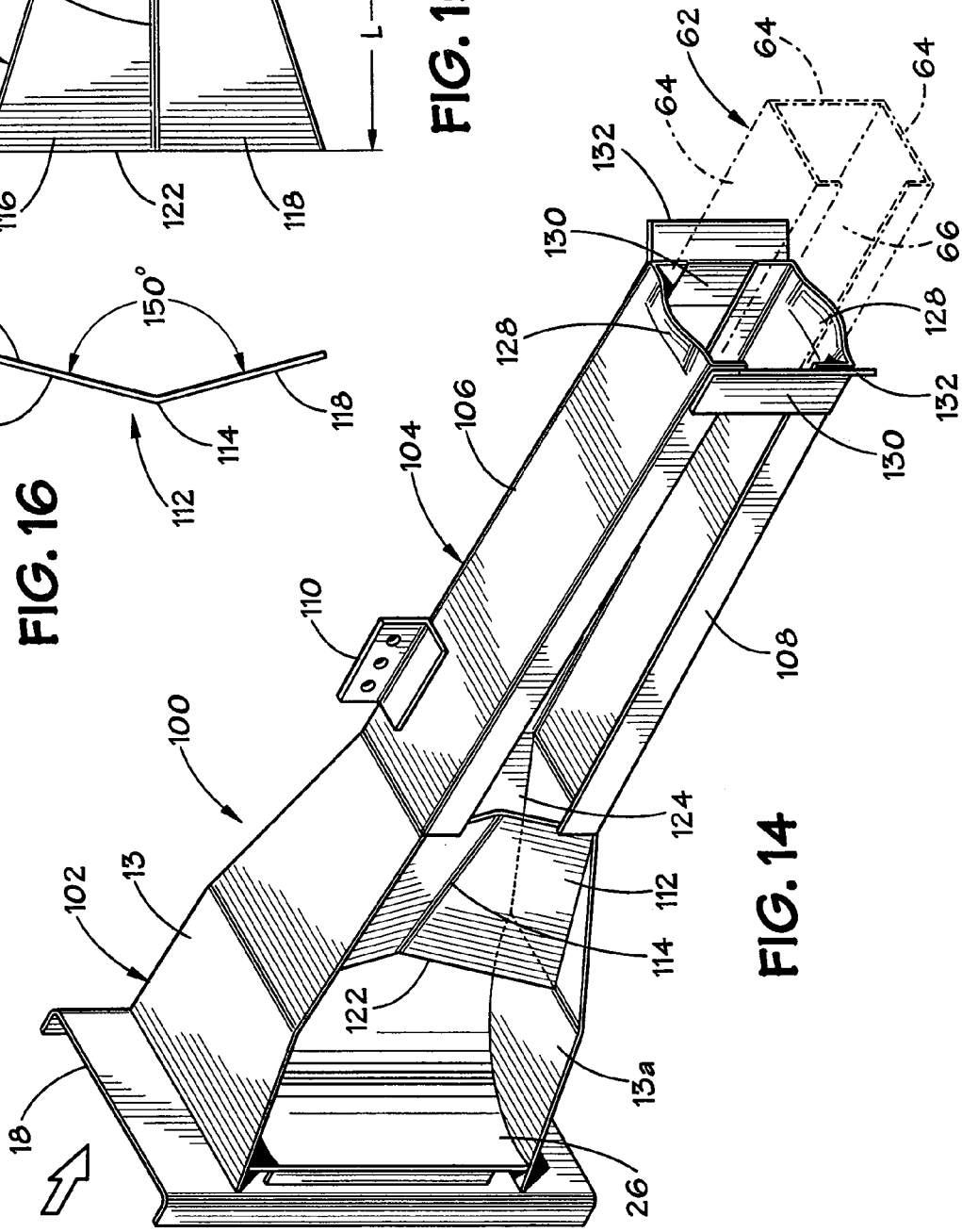
FIG. 14 is an isometric view of the most preferred embodiment for a box beam terminal constructed in accordance with the present invention.

When disposed alongside a roadway as part of a guardrail assembly, the box beam member 60 is oriented so that the open face 66 faces away from the roadway. The box beam terminal 60 also includes a chute portion 70 and an impact head, which is shown generally at 72. The chute portion 70 includes two side plates 74, 76 that define a flattening section 78. One of the side plates 74 has a curved forward portion 26. The other side plate 76 is bent along its longitudinal axis to present a tapered angular cross section with an angular face 80 that is presented toward the other side plate 74. FIG. 9 depicts the side plate 76 and open box beam member 62 apart from other components. FIGS. 10-13 are cross-sections of the side plate 76 and illustrate the effect of forceful contact by the side plate 76 against the open face 66 of the box beam rail member 62. As can be appreciated by reference to these Figures, the angular face 80 is made up of upper and lower faces 82, 84 that are oriented to form an angle to one another that changes depending upon the location along the plate 76. The angle formed between the faces 82, 84 becomes less acute as the upstream end of the terminal 60 is approached. As the exemplary cross-sections of FIGS. 10-13 show, the angle formed varies from 120 degrees to 180 degrees.

During an end-on collision to the impact head 72 of the terminal 60, the open box beam member 62 is forced into the flattening section 78 of the chute portion 70. The box beam member 62 is flattened by a narrowing of the throat 78 that occurs as the upstream end of the chute portion 70 is reached. This flattening helps to cause structural collapse of the box beam member 62. In addition, engagement of the open face 66 with the angular face 80 assists in structural collapse of the box beam member 62. As the box beam member 62 is urged toward the upstream end of the chute portion 70, the increase in angle between the upper and lower faces 82, 84 results in the open face 66 of the box beam member 62 being deformed and opened to a greater degree. The curved portion 26 of the side plate 74 bends the deformed and collapsed beam member 62 away from terminal 60.

Referring now to FIGS. 14, 15, 16, 17, 18, and 19, there is shown a further, and currently most preferred, embodiment for the box beam terminal of the present invention. Terminal 100 includes an impact head 102 and an open box beam member 62. In many respects, the terminal 100 is constructed and operates in a manner similar to the terminal 60 described and shown in FIGS. 8-13. In this embodiment, however, the impact head 102 includes an impact plate 18 that is secured by upper and lower plates 13, 13*a* to a chute portion 104. The chute portion 104 is made up of upper and lower hot or cold rolled channel members 106, 108 that are shaped and sized to receive the box beam rail member 62 therebetween. A bracket 110 is secured to the upper channel member 106 to help in affixing the impact head 102 to a support post 15. A side plate 112 is disposed between the upper and lower plates 13, 13*a*, the structure of which is shown in greater detail in FIGS. 15, 16, and 17. The side plate 112 is bent along bend line 114 to present contact faces 116, 118. The two contact faces 116, 118 preferably lie at an angle of about 150° from one another. The side plate 112, and each of the contact faces 116, 118, has a decreased width at the downstream end 120 of the plate 112 than at the upstream end 122 of the plate 112. Currently, the preferred width of the plate 112 at the upstream end 122 is about 18½ inches while the width at the downstream end 120 is about 11½ inches. The side plate 112 has a currently preferred length "L" of about 12¼ inches, and the preferred thickness of the plate is ⅜ inches.

Figure 18:
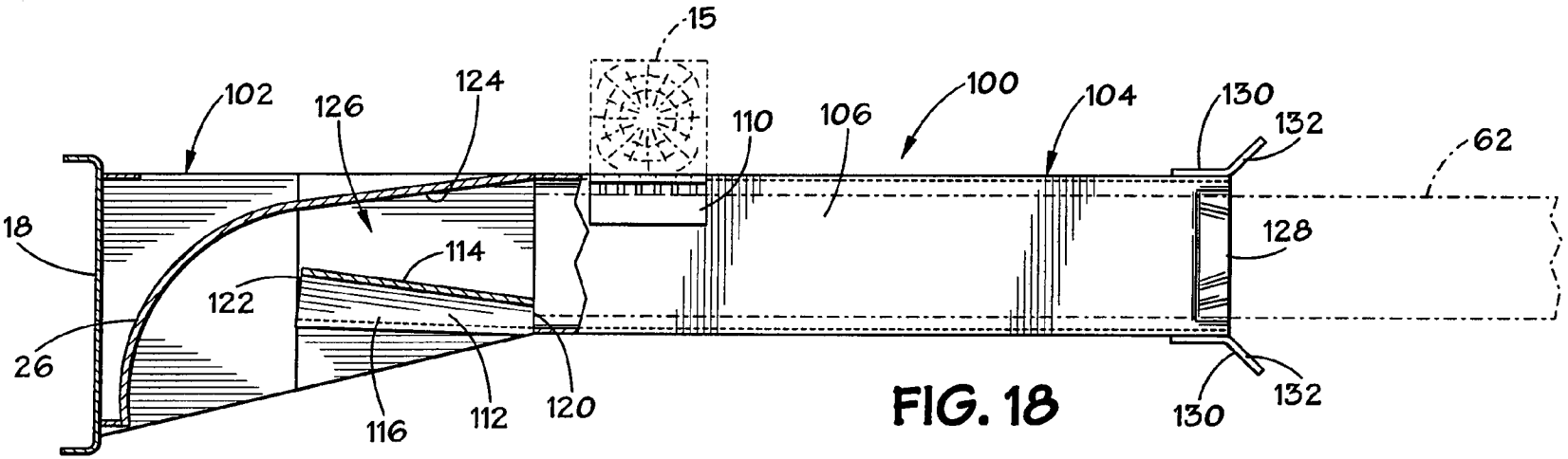
FIG. 18 is a plan, cross-sectional view of the box beam terminal shown in FIG. 14.
Figure 19:
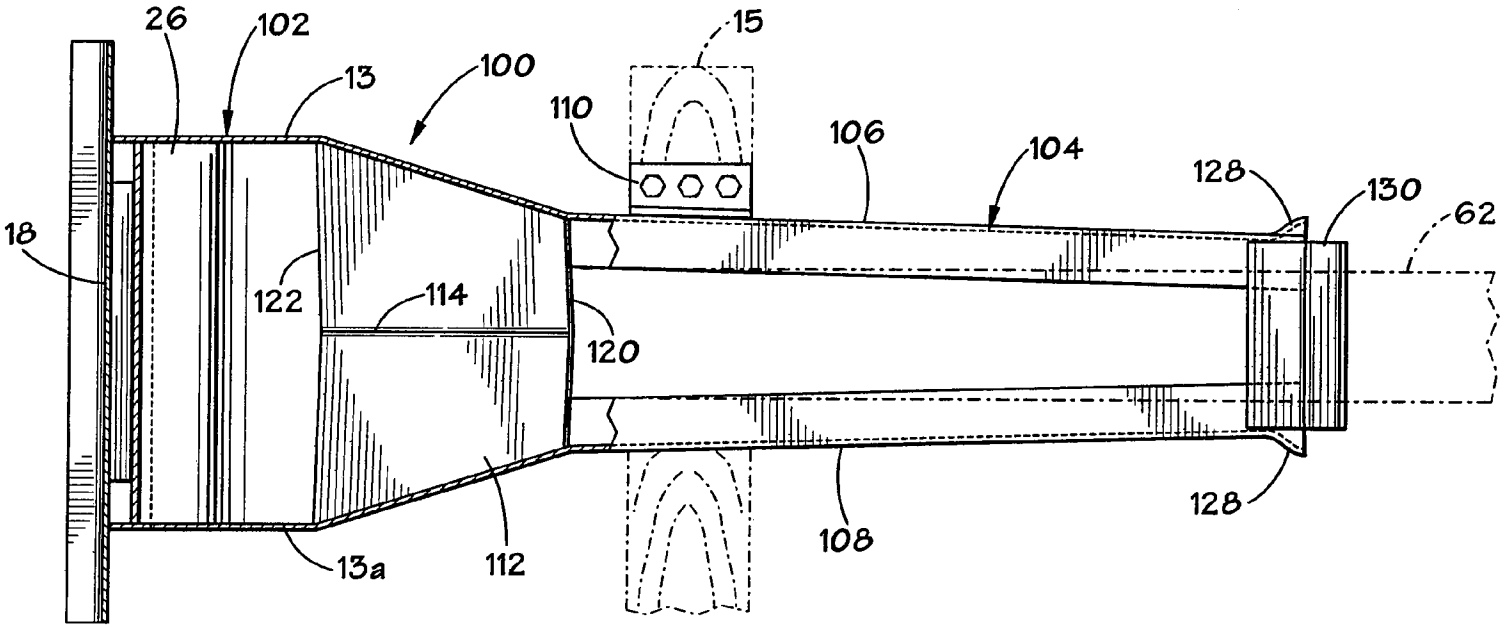
FIG. 19 is a side, cross-sectional view of the box beam terminal shown in FIG. 14.

An opposing side plate 124, most clearly seen in FIG. 18 is integrally formed with the curved plate portion 26. The two side plates 112, 124 converge as the upstream end of the impact head 102 is approached so that a flattening section 126 is formed therebetween. During an end-on collision to the upstream end of the impact head 102, the rail member 62 is flattened within the section 126 formed between the two side plates 112, 124. The flattened beam member is then bent by the curved plate portion 26 in a manner previously described.

The downstream end of each of the channel members 106, 108 has an outwardly flared portion 128 that assists in handling of the impact head 102 during insertion of the box beam rail member 62 upon installation and prevents edges of downstream segments of box beam rail (not shown) from snagging abruptly on the ends of the channel member 106, 108 as the impact head 102 moves downstream. The outwardly flared portions 128 are useful for manually gripping the head 102 and sliding it with respect to the box beam rail member 62. Additionally, brackets 130 are used to interconnect the downstream ends of the channel members 106, 108. The brackets 130 are preferably welded to each of the channel members 106, 108 and include rearwardly and outwardly divergent portions 132. The divergent portions 132 are useful for contacting and breaking support posts 15 that are located downstream of the impact head 102 during an impact. The divergent portions 132 are also useful to prevent snagging of edges of downstream segments of box beam (not shown) on the brackets 130 as the impact head 102 is moved downstream during a vehicular impact. It is pointed out that the brackets 130, divergent portions 132, and outwardly flared portions 128 may be incorporated into any of the embodiments of impact heads described herein, as well.

Figure 20:
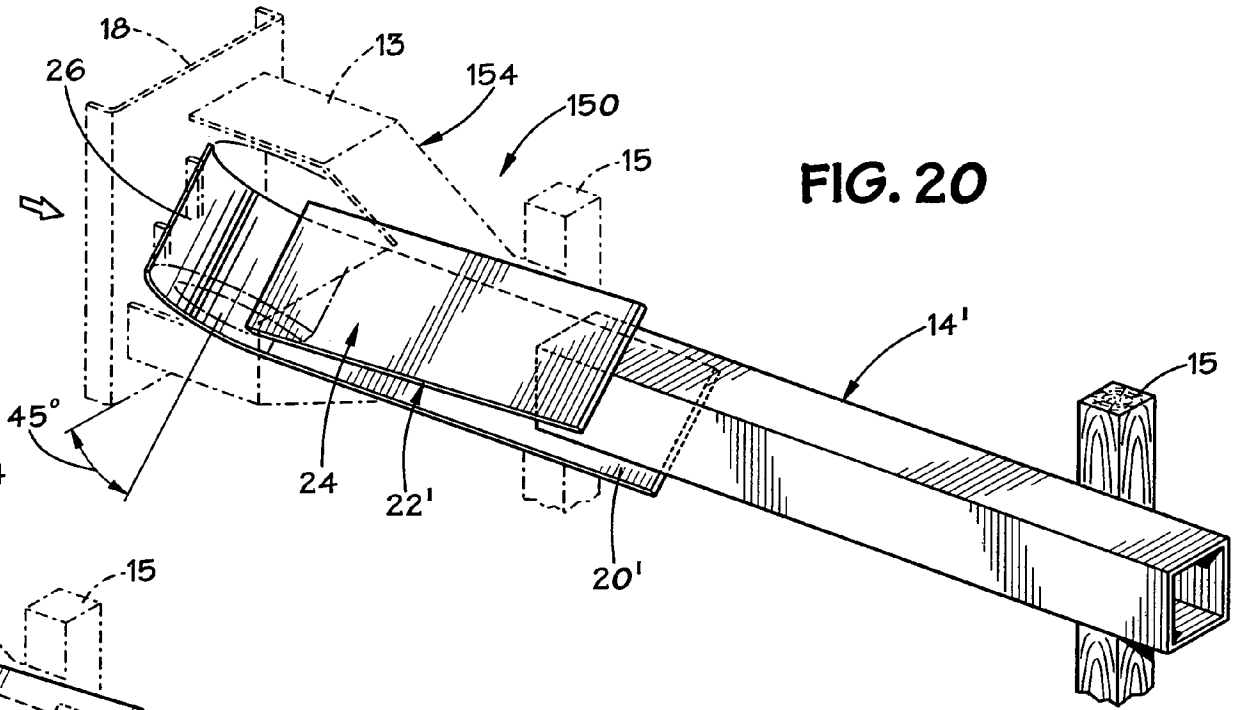
FIG. 20 is an isometric view of a further alternative embodiment for a box beam terminal constructed in accordance with the present invention.
Figure 21:
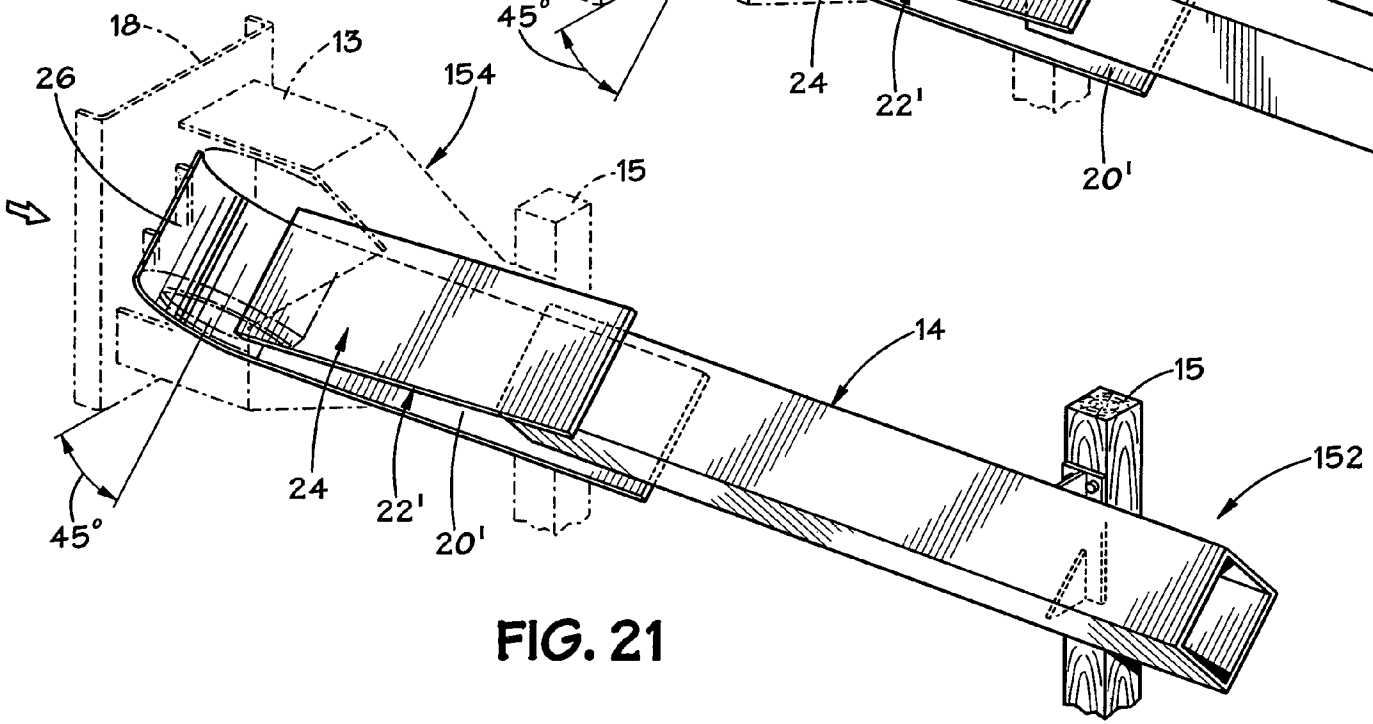
FIG. 21 is an isometric view of a further alternative exemplary embodiment for a box beam terminal constructed in accordance with the present invention.
Figure 23:
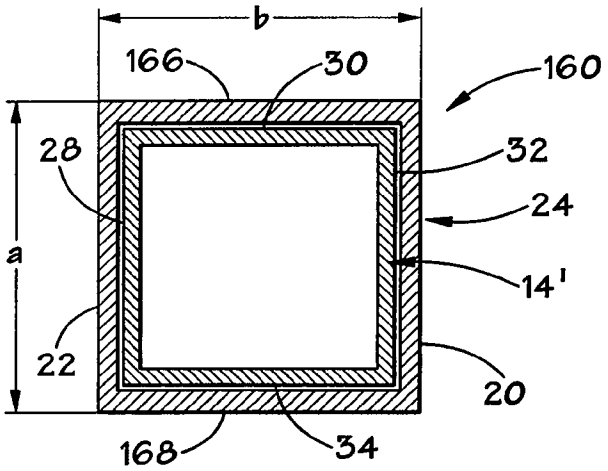
FIG. 23 is a cross-sectional view of portions of an impact head and box beam member taken along the lines 23-23 in FIG. 22.
Figure 22:
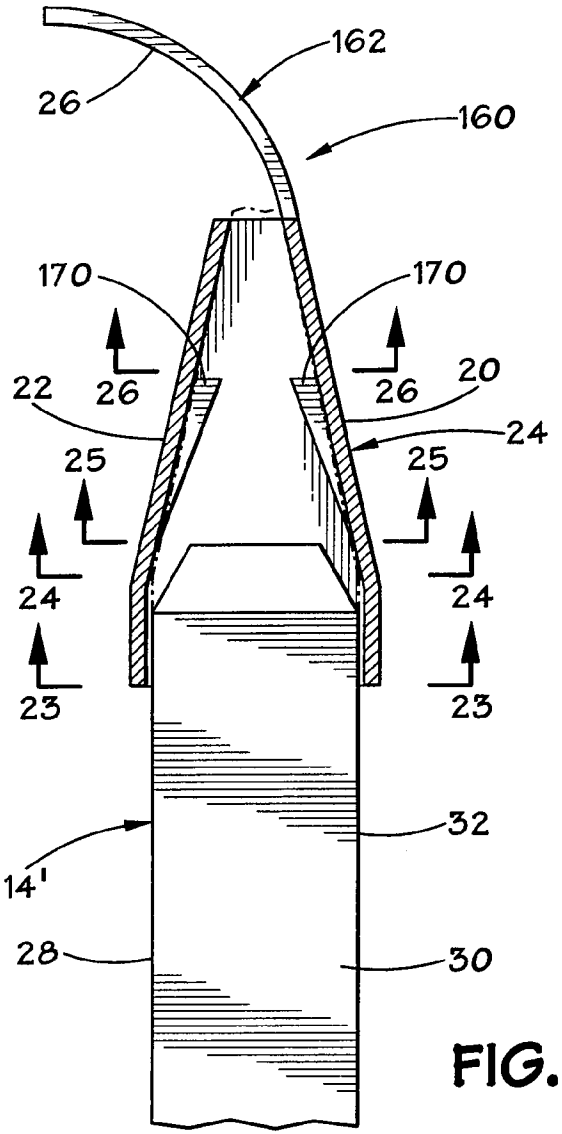
FIG. 22 is a schematic plan view of a further alternative exemplary embodiment for a box beam terminal constructed in accordance with the present invention.

FIGS. 20 and 21 depict two additional alternative box beam terminals 150, 152 that have been constructed in accordance with the present invention. The terminal 150 (FIG. 20) is similar in many respects to the terminal 54 illustrated in FIG. 5. The box beam member 14' is a closed box beam that is mounted so that two of its sides are horizontally disposed, or normal to the longitudinal axis of the support posts 15. However, the chute portion 24 in head 154, including side plates 20, 22 and curved plate portion 26, has been rotated about the axis of beam member 14' approximately 45 degrees from the its previous position, illustrated in FIG. 5. As a result, the beam member 14' is engaged by and subjected to flattening by the chute portion 24 by compressing opposing corners rather than opposing sides, as was the case in terminal 54. While FIG. 20 shows the downstream ends of side plates 20, 22 as being flat, it should be understood that they may also form angles for gripping opposing corners of the rail member 14' in a manner similar to that shown in FIGS. 1 and 2. It is noted that, when the chute portion 24 is oriented as shown in FIG. 20, i.e., having been rotated about the axis of the beam 14', the rail member 14' is deflected and extruded from the impact head 154 in a more upwardly direction than with the previous devices described. Specifically, the rail member 14' will exit the impact head in a direction that forms an approximate 45 degree angle with respect to the ground as well as approximately 45 degrees with the vertical.

FIG. 21 depicts box beam terminal 152, which is a variant of the terminal 150 shown in FIG. 20. The box beam terminal 152 uses an impact head 154 that has been constructed with a chute portion 24 that has been rotated 45 degrees, like terminal 150. However, the box beam rail member 14 also has been rotated 45 degrees about its axis so that none of the four sides of the beam member 14 is horizontally disposed. In the terminal 152, the impact head 154 will engage the box beam member 14 so that it will be compressed upon opposite sides rather than opposite corners.

Figure 26:
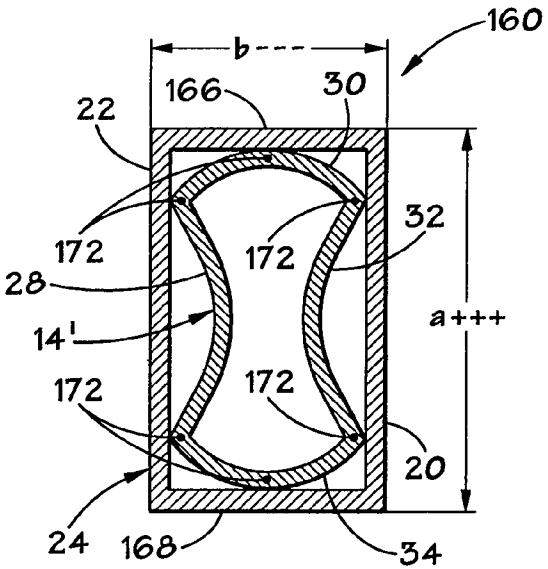
FIG. 26 is a cross-sectional view of portions of an impact head and box beam member taken along the lines 26-26 in FIG. 22.
Figure 25:
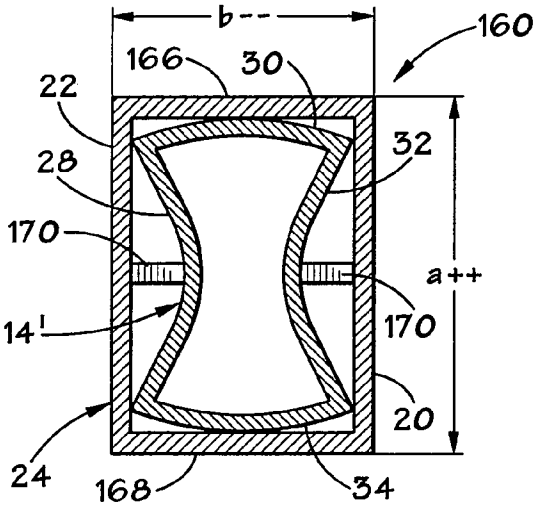
FIG. 25 is a cross-sectional view of portions of an impact head and box beam member taken along the lines 25-25 in FIG. 22.
Figure 24:
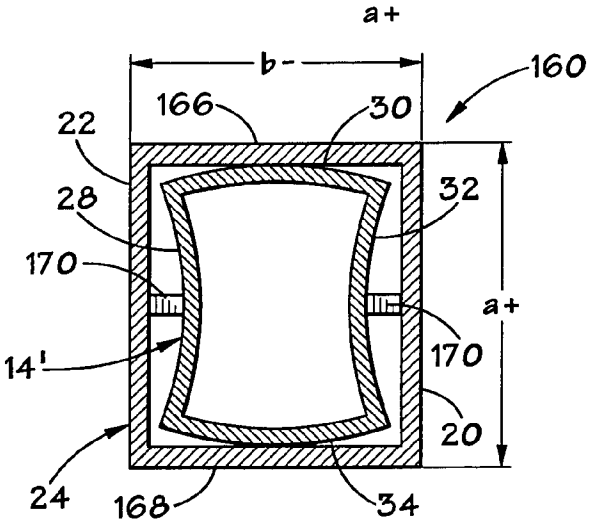
FIG. 24 is a cross-sectional view of portions of an impact head and box beam member taken along the lines 24-24 in FIG. 22.

FIGS. 22-26 schematically illustrate still a further alternative box beam terminal embodiment 160 constructed in accordance with the present invention. The terminal 160 features an impact head 162 that is disposed upon the upstream end of a closed box beam rail member 14'. The impact head 162 includes a chute portion 24 that has two side plates 20,22 as well as upper and lower plates 166, 168, respectively, all of which are interconnected (as shown in FIGS. 23-26) so as to provide a closed cross-section. Proximate the downstream opening for the chute portion 24, the side plates 20, 22 have a height "a", and the upper and lower plates 166, 168 have a width "b" (see FIG. 23). However, as the upstream end of the impact head 162 is approached, the height of the side plates 20, 22 increases, as illustrated by the dimensions a+, a++, and a+++in FIGS. 24, 25, and 26. Conversely, the width of the upper and lower plates 166, 168 decreases, as illustrated by the dimensions b−, b−−, and b−−− in FIGS. 24, 25, and 26. The chute portion 24 incorporates tapered deflection bars 170 (visible in FIGS. 24-25) that are mounted on the side walls 20, 22 of the chute portion 24. The deflection bars 170 engage opposing sides 28, 32 of the box beam member 14'. As the impact head 162 is moved downstream onto the beam member 14', the sides 28, 32 are deformed and deflect inwardly toward one another. This deflection causes the upper and lower sides 30, 34 of the beam member 14' to be deflected outwardly, as FIGS. 24-26 depict. When the beam member 14' is cross-sectionally deformed in this manner, it becomes easier for the curved plate portion 26 to bend and deflect the beam member 14'. As the box beam member 14'is forced upstream beyond the cross-section shown in FIG. 25, the deflected shape of the beam member 14' and the decreasing width dimension "b" of the upper and lower plates 166, 168 are sufficient to cause the beam member to continue to flatten.

FIG. 26 illustrates a further feature that can assist the impact head 160 in collapsing and bending the beam member 14'. Plastic hinges 172 are shown formed into the walls of the box beam member 14'. The plastic hinges 172 contribute to the dissipation of the impacting vehicle's energy in the form of strain energy. Vehicular energy is also dissipated through friction between the box beam 14' and the deflection bars 170 as well as through friction between the box beam member 14' and other portions of the chute 24. Vehicular energy is further dissipated by further deformations of the flattened box beam as it is forced around the curved deflector section of the terminal.

Box beam terminals constructed in accordance with the current invention provide for a controlled, uniform deceleration of an impacting vehicle. The variability of impact force on the vehicle associated with such deceleration is greatly reduced with the new invention. Long, slender telescoping tubes, such as those used in some prior art systems, can have stability problems when impacted in an eccentric manner. Such stability problems can restrict the telescoping behavior. Crushable composite tubes are also subject to manufacturing variability, which can influence the magnitude of the crush force. Further, the decelerations resulting from staged composite tube design are sensitive to vehicle mass and impact speed. The current invention minimizes stability issues. Material costs are also reduced with the present invention, particularly over systems that utilize more expensive or difficult to obtain materials, such as fiber-reinforced composite tubes.

Those of skill in the art will recognize that numerous modifications and changes may be made to the exemplary designs and embodiments described herein and that the invention is limited only by the claims that follow and any equivalents thereof.

What is claimed is:

1. A box beam rail terminal comprising:

a rail member having four sides and an upstream end, the four sides positioned substantially orthogonal to each other to define a substantially box-shaped rail member;

an impact head mounted on the upstream end of the box beam rail member, the impact head comprising:

a striking plate for receiving an impacting vehicle;

a chute portion having a pair of converging side plates for receiving the upstream end of the box-shaped rail member, each side plate positioned proximate an opposing side of the box-shaped rail member, the pair of converging side plates compressing the opposing sides of the box-shaped rail member toward each other to flatten the box-shaped rail member during a substantially end-on collision; and a curved plate portion for bending and deflecting a portion of the box-shaped rail member.

2. A box beam rail terminal comprising:

a longitudinal box beam rail member comprising four sides and presenting an upstream end, the four sides positioned substantially orthogonal to each other to define a substantially box-shaped rail member;

an impact head mounted on the upstream end of the box beam rail member, the impact head comprising:

a striking plate for receiving an impacting vehicle;

a chute portion comprising a pair of side plates for receiving the upstream end of the box beam rail member, the pair of side plates configured to flatten the box beam rail member by compressing opposing sides of the box beam rail member toward each other; and a curved plate portion for bending and deflecting a portion of the rail member.

3. The box beam rail terminal of claim 2, wherein the pair of side plates converge in an upstream direction.

4. The box beam rail terminal of claim 2, further comprising a deflection bar mounted upon at least one of the pair of side plates, the deflection bar positioned to engage and deform one of the four sides of the box beam rail member.

5. The box beam rail terminal of claim 2, wherein the box beam rail member comprises a closed box beam member having a closed cross-section.

6. The box beam rail terminal of claim 2, wherein the first and second side plates each comprise substantially flat plates.

7. The box beam rail terminal of claim 2, wherein the four sides of the longitudinal box beam rail member comprise a first pair of opposing sides and a second pair of opposing sides, and wherein the pair of side plates of the chute converge to compress the second pair of sides of the box beam rail member toward each other to flatten the longitudinal box beam rail member.

8. The box beam rail terminal of claim 7, wherein at least one of the first pair of sides includes a score along an upstream portion of the longitudinal box beam rail member, the score assisting an inward collapse of the rail member during a collision.

9. The box beam rail terminal of claim 7, wherein at least one of the first pair of sides includes a seam along an upstream portion of the longitudinal box beam rail member, the seam assisting an inward collapse of the rail member during a collision.

10. The box beam rail terminal of claim 7, wherein:

the first pair of sides of the longitudinal box beam rail member are substantially horizontally disposed;

the second pair of sides of the longitudinal box beam rail member are substantially vertically disposed; and the first and second side plates of the chute are substantially vertically disposed.

11. The box beam rail terminal of claim 7, wherein none of the first pair of sides and the second pair of sides of the longitudinal box beam rail member are horizontally disposed.

12. The box beam rail terminal of claim 2, wherein the chute portion further comprises an upper plate and a lower plate, the upper plate, the lower plate, and the pair of side plates coupled to form a closed cross-section.

13. The box beam rail terminal of claim 12, wherein:

the chute portion has an upstream end and a downstream end;

the pair of side plates having a first height at the downstream end and a second height at the upstream end, the second height greater than the first height; and the upper and lower plates each having a first width at the downstream end and a second width at the upstream end, the second width less than the first width.

14. A box beam rail terminal comprising:

a longitudinal box beam rail member having four sides coupled to form a substantially tubular rail member;

an impact head comprising:

a striking plate for receiving an impacting vehicle; and a flattening portion for flattening and bending the substantially tubular rail member during a substantially end-on collision, the flattening portion having a pair of converging contact faces for contacting and compressing opposing sides of the substantially tubular rail member toward each other.

15. The box beam rail terminal of claim 14 wherein, the flattening portion comprises:

a first side plate and a second side plate that converge in an upstream direction; and a curved plate.

16. The box beam rail terminal of claim 15, further comprising a deflection bar mounted upon at least one of the first and second side plates, the deflection bar positioned to engage and deform one of the four sides of the box beam rail member.

17. The box beam rail terminal of claim 15, wherein the first and second side plates each comprise substantially flat plates.

18. The box beam rail terminal of claim 15, wherein the four sides of the longitudinal box beam rail member comprise a first pair of opposing sides and a second pair of opposing sides, and wherein the pair of side plates of the chute converge to compress the second pair of sides of the box beam rail member toward each other to flatten the longitudinal box beam rail member.

19. The box beam rail terminal of claim 18, wherein:

the first pair of sides of the longitudinal box beam rail member are substantially horizontally disposed;

the second pair of sides of the longitudinal box beam rail member are substantially vertically disposed; and the first and second side plates of the chute are substantially vertically disposed.

20. The box beam rail terminal of claim 18, wherein none of the first pair of sides and the second pair of sides of the longitudinal box beam rail member are horizontally disposed.

21. The box beam rail terminal of claim 15, wherein the flattening portion further comprises an upper plate and a lower plate, and wherein the upper plate, the lower plate, and the pair of side plates are coupled to form a closed cross-section.

22. The box beam rail terminal of claim 21 wherein:

the flattening portion has an upstream end and a downstream end;

the pair of side plates having a first height at the downstream end and a second height at the upstream end, the second height greater than the first height; and the upper and lower plates each having a first width at the downstream end and a second width at the upstream end, the second width less than the first width.

23. The box beam rail terminal of claim 14, wherein at least one of the four sides includes a score along an upstream portion of the longitudinal box beam rail member, the score assisting an inward collapse of the rail member during a collision.

24. The box beam rail terminal of claim 14, wherein at least one of the four sides includes a seam along an upstream portion of the longitudinal box beam rail member, the seam assisting an inward collapse of the rail member during a collision.

* * * * *